US011780671B2

(12) United States Patent
Miller

(10) Patent No.: US 11,780,671 B2
(45) Date of Patent: Oct. 10, 2023

(54) REFUSE CONTAINERS AND LIDS

(71) Applicant: iDeaWare Squared, Inc., Merritt Island, FL (US)

(72) Inventor: David H. Miller, Merritt Island, FL (US)

(73) Assignee: iDeaWare Squared, Inc., Merritt Island, FL (US)

( * ) Notice: Subject to any disclaimer, the term of this patent is extended or adjusted under 35 U.S.C. 154(b) by 0 days.

(21) Appl. No.: 17/003,623

(22) Filed: Aug. 26, 2020

(65) Prior Publication Data

US 2021/0061556 A1 Mar. 4, 2021

Related U.S. Application Data

(60) Provisional application No. 62/891,557, filed on Aug. 26, 2019.

(51) Int. Cl.

| | |
|---|---|
| ***B65D 43/20*** | (2006.01) |
| ***B65F 1/16*** | (2006.01) |
| ***B65F 1/06*** | (2006.01) |
| ***B65F 1/14*** | (2006.01) |

(52) U.S. Cl.

CPC ..... *B65F 1/1607* (2013.01); *B65F 1/06* (2013.01); *B65F 1/1473* (2013.01)

(58) Field of Classification Search

CPC ..... B65F 1/06; B65F 1/1607; B65F 1/1473; B65F 1/16

USPC ..... 220/908, 908.1, 495.06, 495.08, 495.11

See application file for complete search history.

(56) References Cited

U.S. PATENT DOCUMENTS

| | | | | |
|---|---|---|---|---|
| 1,212,305 | A | 1/1917 | Worsell | |
| 3,170,183 | A | 2/1965 | Leatherman | |
| 4,600,113 | A | 7/1986 | DeMars | |
| 4,836,394 | A | 6/1989 | Glomski | |
| D345,837 | S | 4/1994 | Bean | |
| D355,514 | S | 2/1995 | Breen | |
| 5,547,104 | A | 8/1996 | Parker | |
| D376,235 | S | 12/1996 | Presnell | |
| 5,624,050 | A | 4/1997 | Haas | |
| 5,673,811 | A * | 10/1997 | Dickinson | B65D 43/02 220/815 |
| 6,244,458 | B1 | 6/2001 | Frysinger | |
| 6,520,554 | B2 | 2/2003 | Ditzik | |
| D520,702 | S | 5/2006 | Miller | |
| 7,185,783 | B1 | 3/2007 | Miller | |
| D542,000 | S | 5/2007 | Miller | |
| D575,020 | S | 8/2008 | Miller | |
| 7,469,798 | B1 | 12/2008 | Miller | |
| 10,070,935 | B2 * | 9/2018 | Waimberk | A61B 50/362 |
| D840,126 | S * | 2/2019 | Miller | D34/5 |
| 2002/0003144 | A1 | 1/2002 | Grimes | |

(Continued)

*Primary Examiner* — John K Fristoe, Jr.
*Assistant Examiner* — Elizabeth J Volz
(74) *Attorney, Agent, or Firm* — Tyler A. Stevenson

(57) ABSTRACT

A container assembly for collecting and/or storing refuse, the assembly comprising a container body and a lid, wherein the container body comprises a wall section and a lower base section defining a container body interior, the container body having an open top end, the lid is configured to enclose the body open end, the lid comprises an opening configured for insertion of matter into the container body, the lid opening accounts for a portion of a total surface area of the lid and the opening, and the lid comprises a door configured to open and close the lid opening.

20 Claims, 7 Drawing Sheets

(56) References Cited

U.S. PATENT DOCUMENTS

| | | | | |
|---|---|---|---|---|
| 2011/0024430 | A1* | 2/2011 | Meissen | B65F 1/1646<br>220/849 |
| 2013/0234409 | A1* | 9/2013 | Lin | B65F 1/1473<br>280/47.26 |

* cited by examiner

REFUSE CONTAINERS AND LIDS

The disclosure is directed to containers and lids for use with the containers. In some embodiments, the containers are refuse containers, for instance for use by landscapers and gardeners.

Large refuse containers generally have large top openings for inserting plastic garbage bags or liners filled with garbage, garden debris, recyclable materials, items to be stored, etc. Large containers having large openings are generally paired with a large lid or cover suitable to cover the opening. The lids may be separated from a container body and may "snap-on" the container.

In many instances, for instance in commercial or household uses, complete removal of a lid to set it aside during use and to place it back on a container requires extra steps and effort. Desired is a container having a lid that may reduce the effort involved when repeatedly placing items in a container over a period of time or when it is otherwise inconvenient to completely remove or open a lid.

Also desired is a more suitable refuse container that may be laid on its side in order to sweep, rake, or blow debris into.

SUMMARY

Accordingly, disclosed is a container assembly for collecting and/or storing refuse, the assembly comprising a container body and a lid, wherein the container body comprises a wall section and a lower base section defining a container body interior, the container body having an open top end, the lid is configured to enclose the body open end, the lid comprises an opening configured for insertion of matter into the container body, the lid opening accounts for a portion of a total surface area of the lid and the opening, and wherein the lid comprises a door configured to open and close the lid opening. Also disclosed are suitable containers. Also disclosed are lids configured to enclose a container, wherein the lid comprises an opening and a door configured to open and close the lid opening.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DISCLOSURE

Figure 1A:
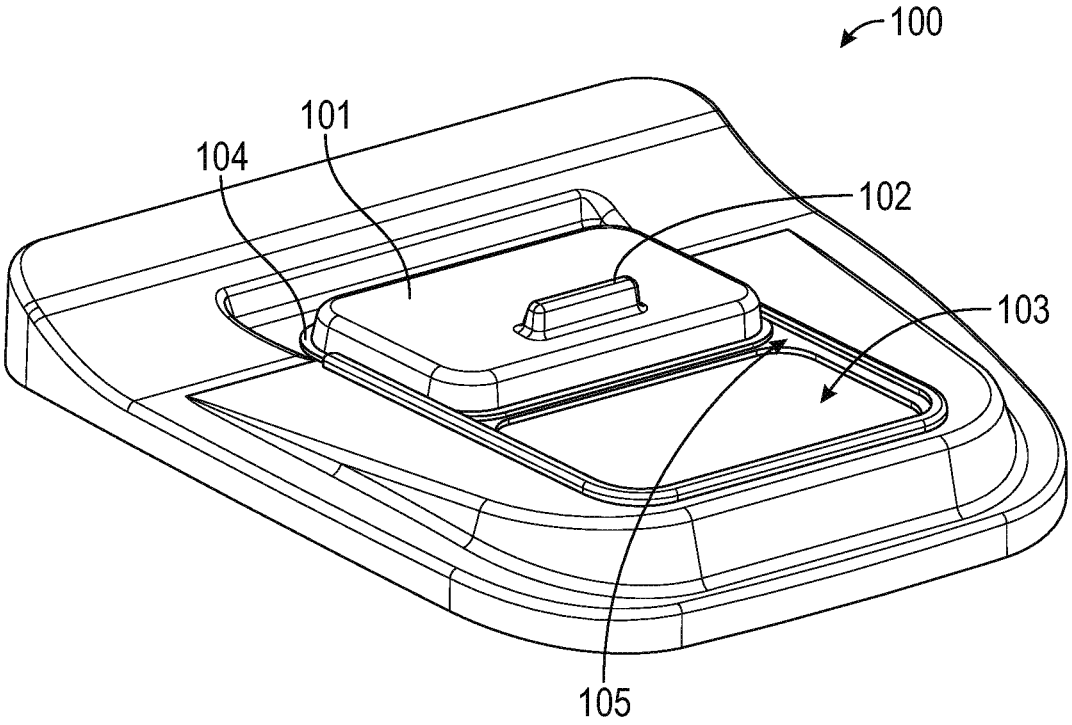
FIG. 1A and FIG. 1B depict a lid, according to an embodiment.
Figure 1B:
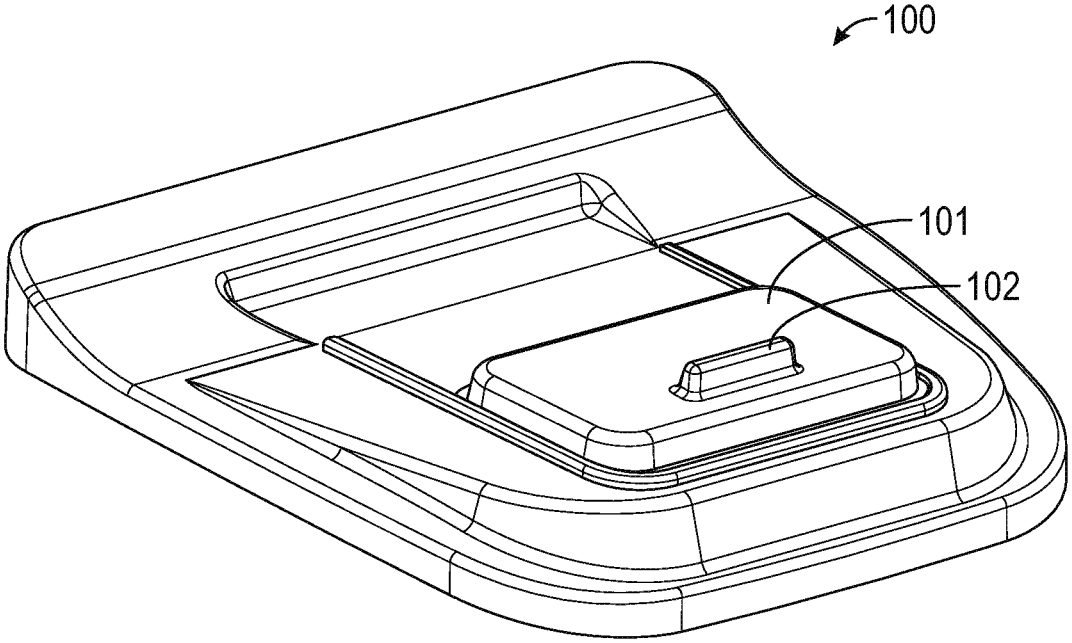

FIG. 1A and FIG. 1B show lid 100 for a container comprising door 101, according to an embodiment. FIG. 1A shows lid door 100 in an open position and FIG. 1B shows lid door 100 in a closed position. Lid door 100 comprises upwardly extending handle 102 configured to allow an operator to open and close lid opening 103 via sliding the door from front to back. Lid 100 comprises a substantially trapezoidal shape. Lid opening 103 accounts for a portion of the overall surface area of the lid (lid plus lid opening). Lid door 101 comprises flanges 104 configured to couple to and slide in grooves 105.

Figure 2A:
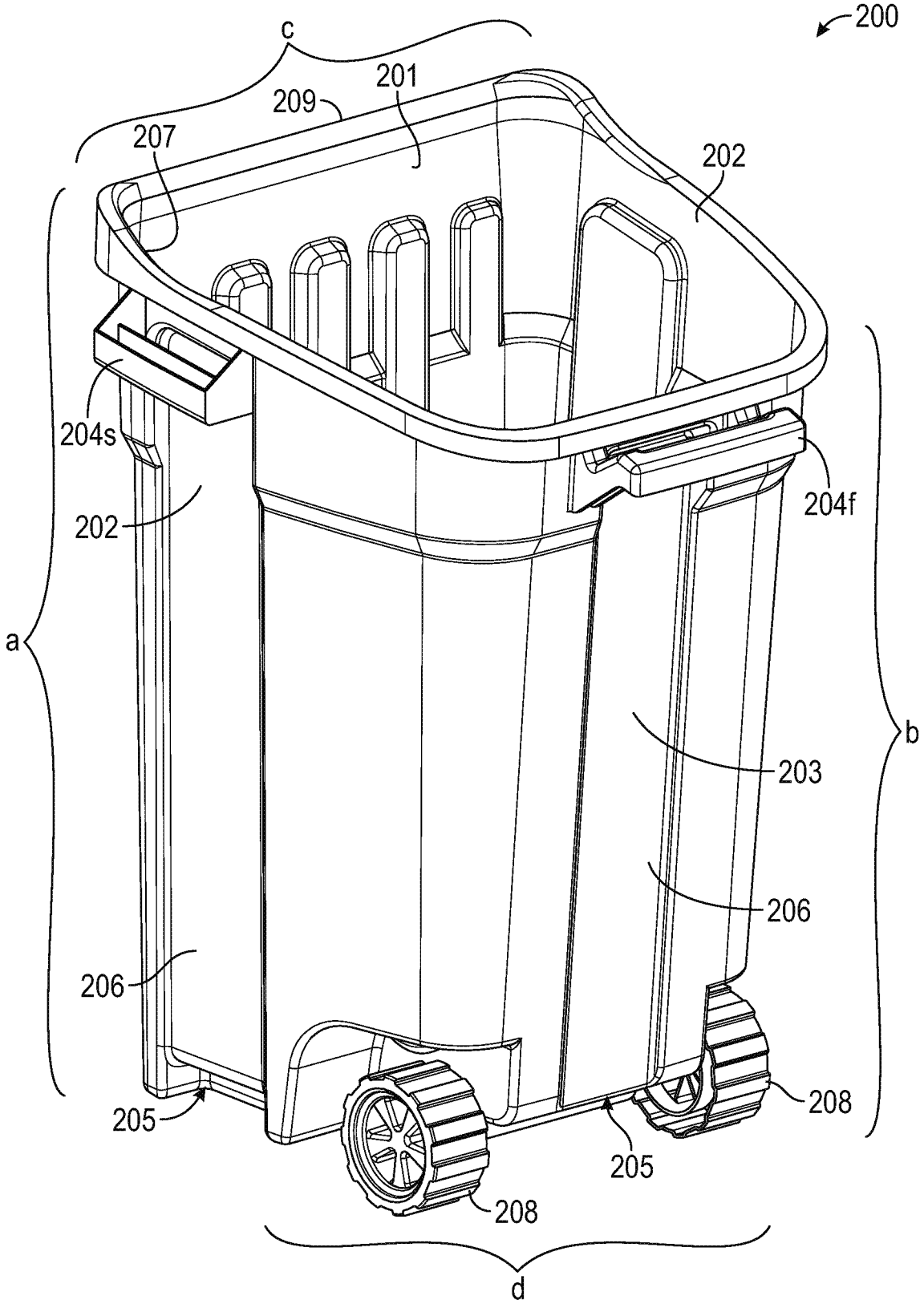
FIG. 2A and FIG. 2B provide views of a refuse container, according to an embodiment.

FIG. 2A shows refuse container 200, according to an embodiment. Container 200 comprises rear wall 201, side walls 202, and front wall 203. Rear wall 201 comprises width c and length a. Front wall 203 comprises width d and length b. Rear wall 201 is longer and wider than front wall 203. Handles 204*s* and 204*f* extend from side walls 202 and front wall 203 towards a top body section, respectively. Recessed handles 205 are positioned on side walls 202 and front wall 203 towards a body lower or bottom section. Recessed handles 205 and handles 204*s* and 204*f* are positioned in or straddling recessed sections 206 that run along the length of walls 202 and 203 and are aligned along sections 206. Recessed handles 205 may comprise a hollow gripping portion configured to be gripped with an operator's fingers and hand. A wall recessed section may allow more space for an operator's hand to grip an extending handle. Also in this embodiment, side wall top handles 204*s* are angled, substantially following an angle of container top edge 207. The overall handle configuration is highly ergonomic. Wheels 208 are present towards a front of container 200.

Figure 2B:
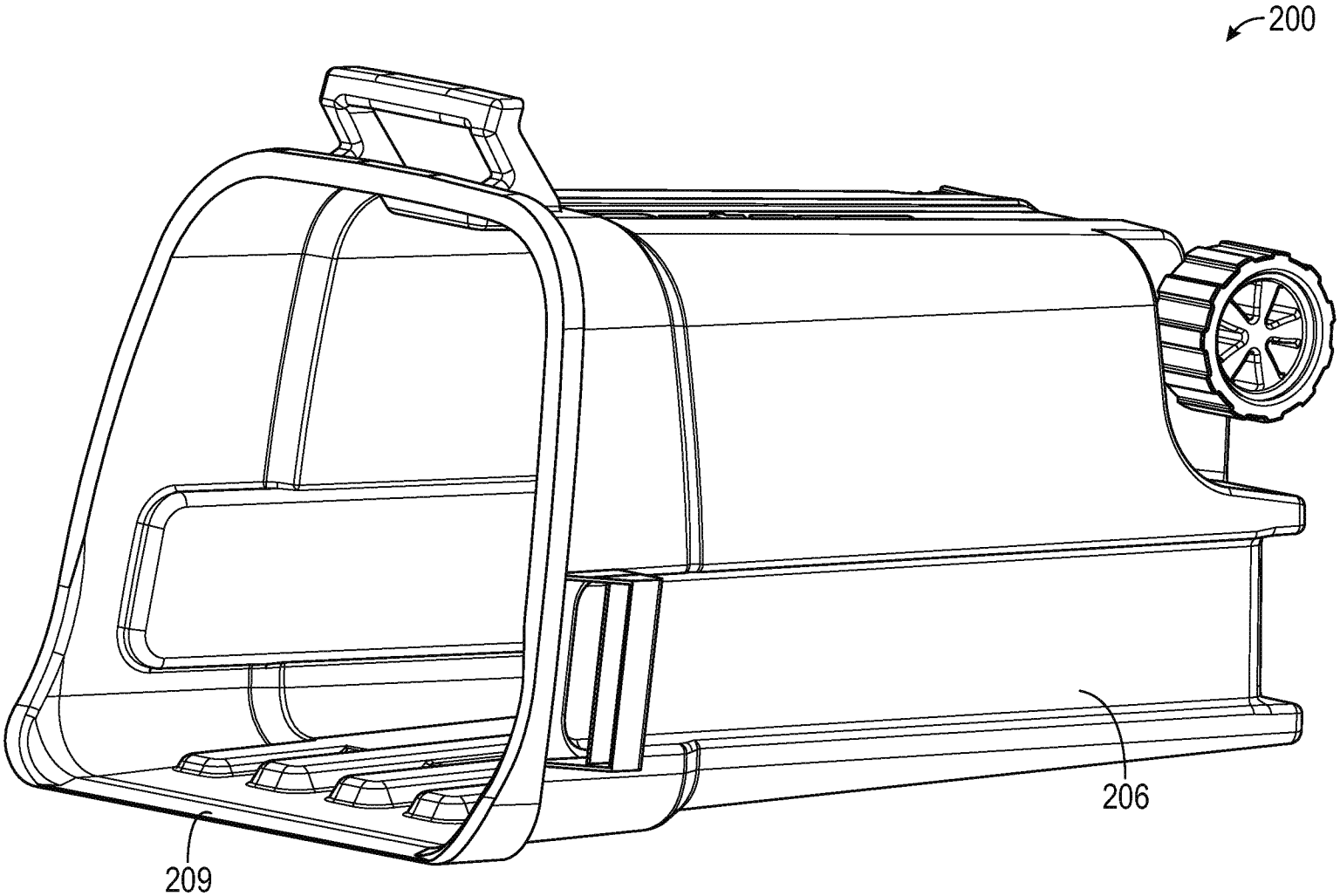

Also in this embodiment, rear wall 201 comprises no extending handle. Rear wall 201 is essentially flat with no extending features so that it may be laid on its side in order for an operator to sweep, rake or blow debris into the container. Rear wall 201 is corrugated which adds strength to the wall configured to receive the weight of debris. Top rear edge 209 is substantially straight and flat, configured to work not unlike a dust pan. Also, the left and right top edges are curved towards rear edge 209 and rear wall 201, thereby providing a dust pan-like edge. Rear top edge 209 may also be configured to receive and removably couple to a dust pan-adapter. FIG. 2B shows refuse container laid on its side in order to operate like a dust pan.

Figure 3:
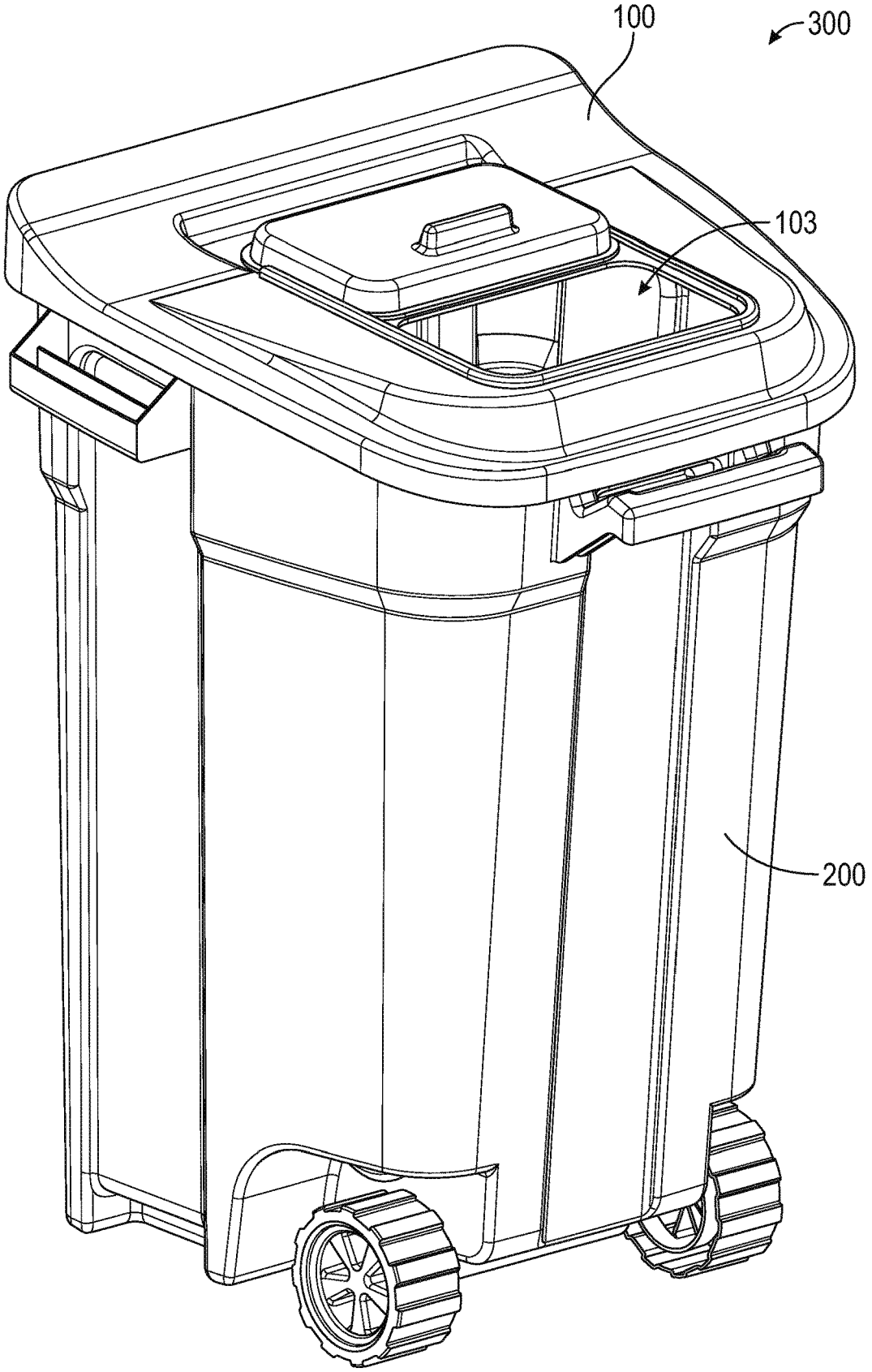
FIG. 3 shows a view of a refuse container/lid assembly, according to an embodiment.

FIG. 3 provides a view of refuse container/lid assembly 300, according to an embodiment, comprising lid 100 and container 200. Assembly 300 comprises is substantially trapezoidal in shape. Lid 100 is in an open position providing opening 103.

Figure 4A:
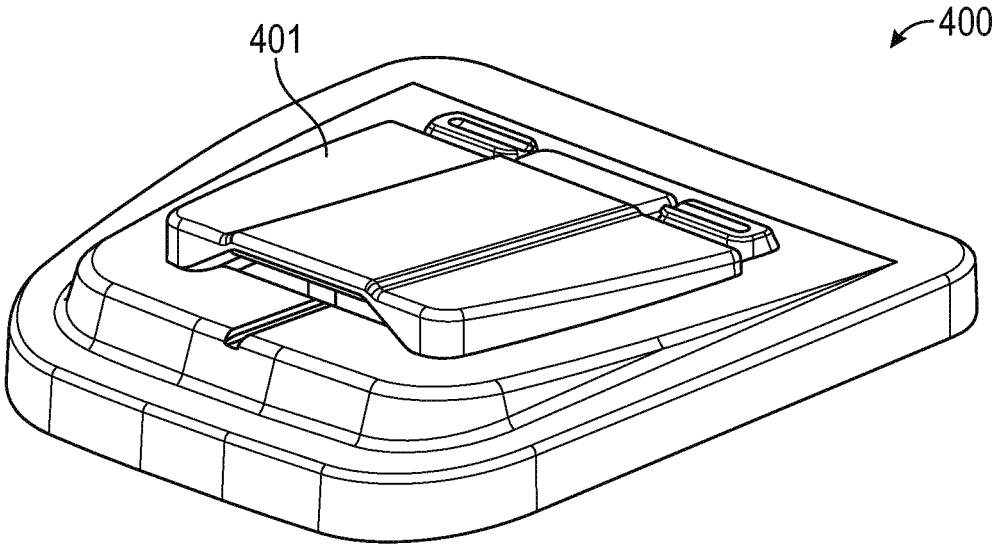
FIG. 4A and FIG. 4B provide views of a lid, according to some embodiments.
Figure 4B:
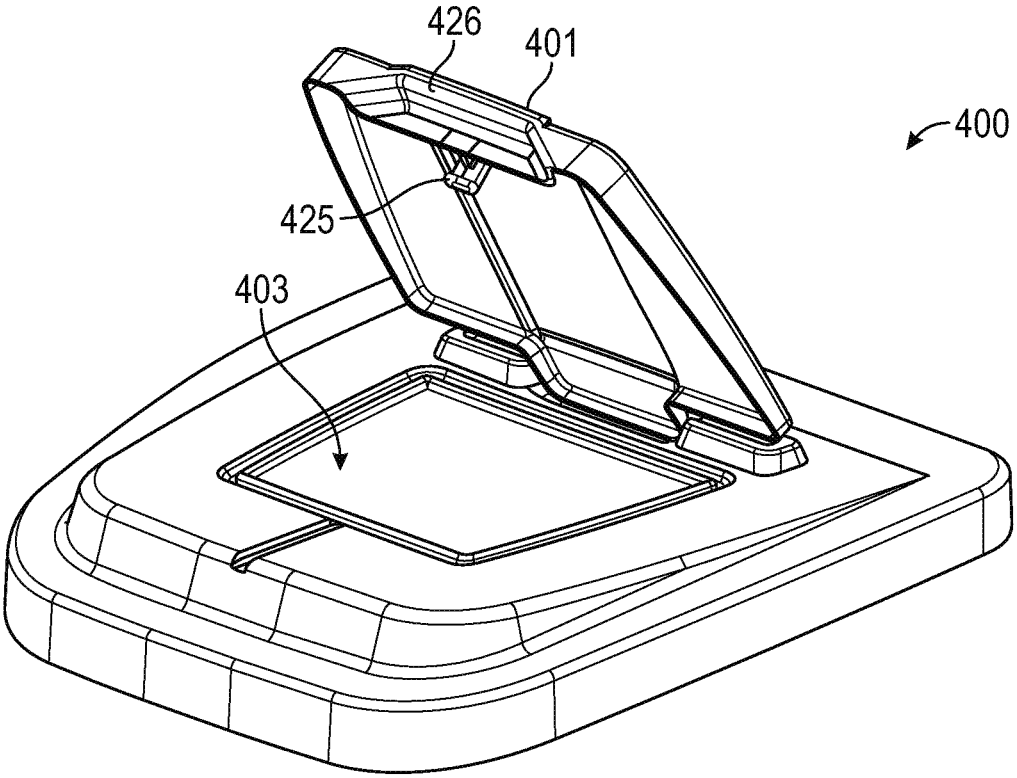

FIG. 4A and FIG. 4B show lid for a container 400 having hinged door 401, according to an embodiment. Door 401 comprises handle 426 and latch 425.

Figure 5A:
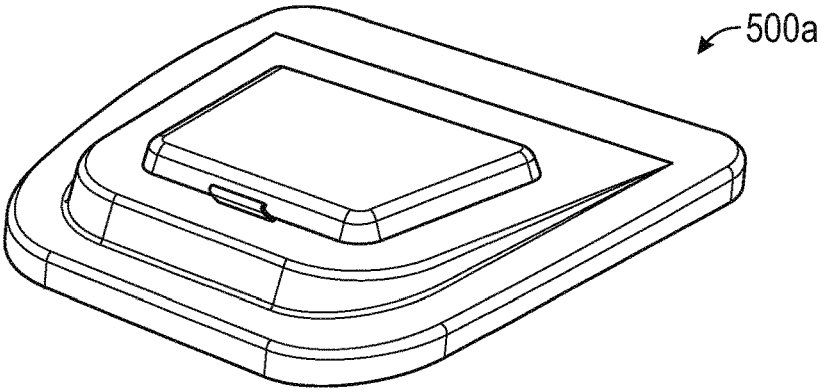
FIG. 5A, FIG. 5B, and FIG. 5C show views of lids, according to some embodiments.
Figure 5B:
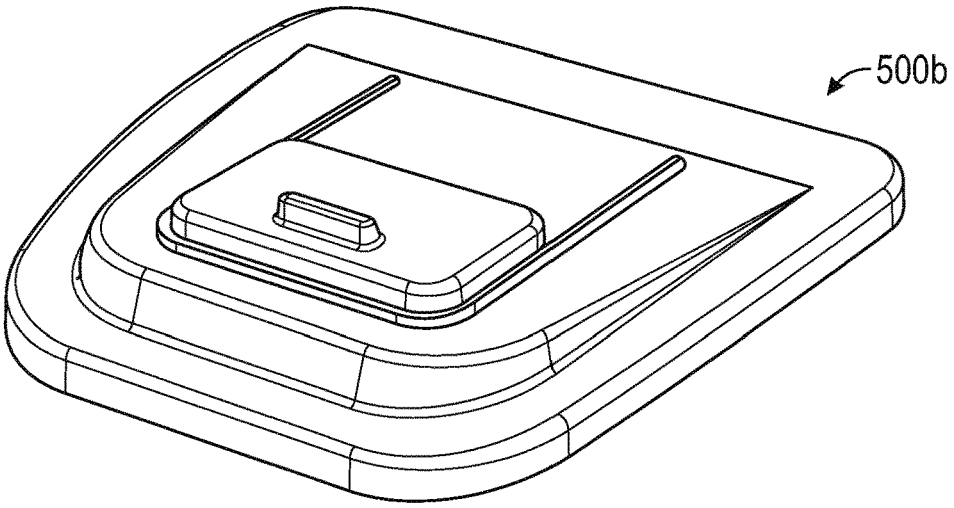
Figure 5C:
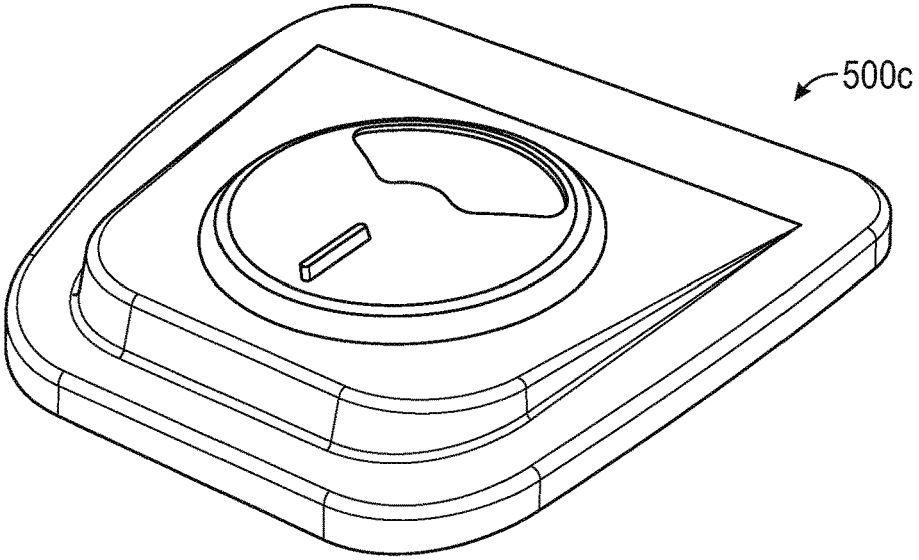

FIG. 5A, FIG. 5B, and FIG. 5C show container lids 500*a*, 500*b*, and 500*c*, with doors which may open "up", slidably open and close, or rotationally (rotatably) open and close, respectively, according to some embodiments.

Figure 6B:
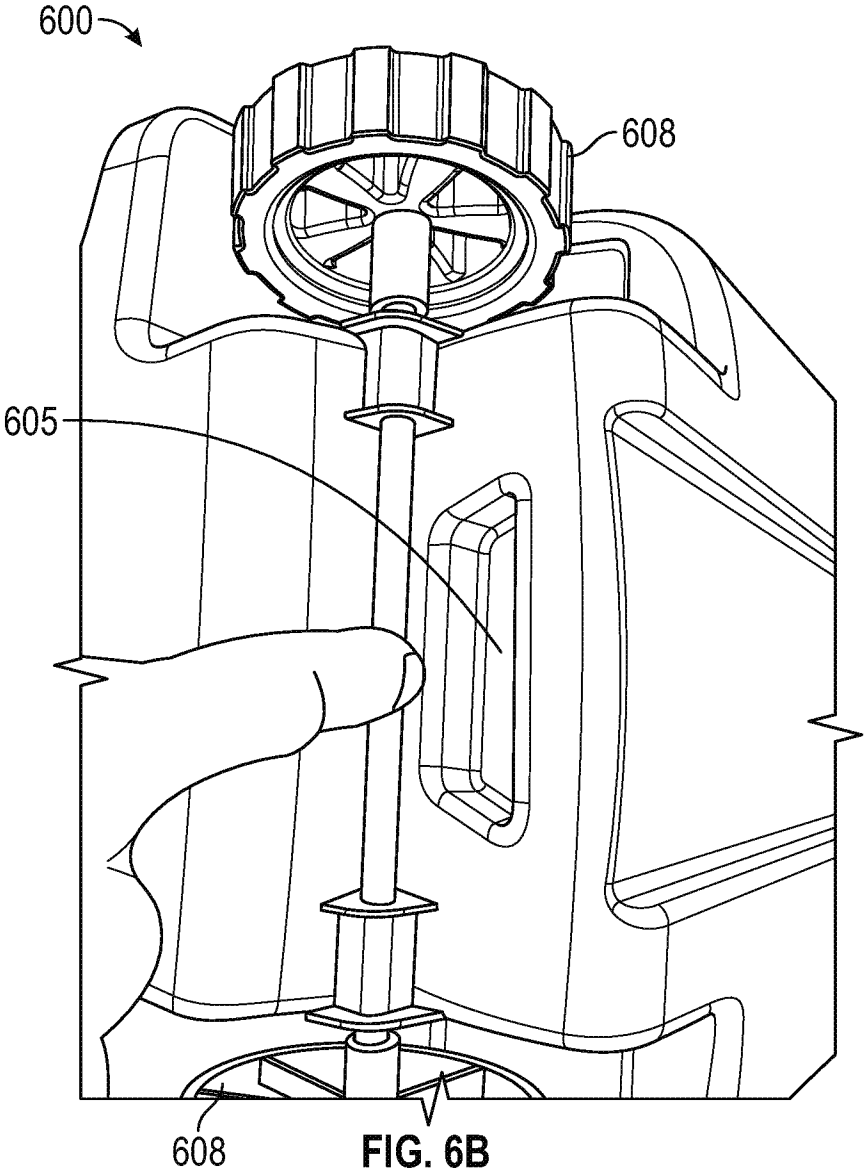
FIG. 6A and FIG. 6B show partial views of a refuse container, according to an embodiment.
Figure 6A:
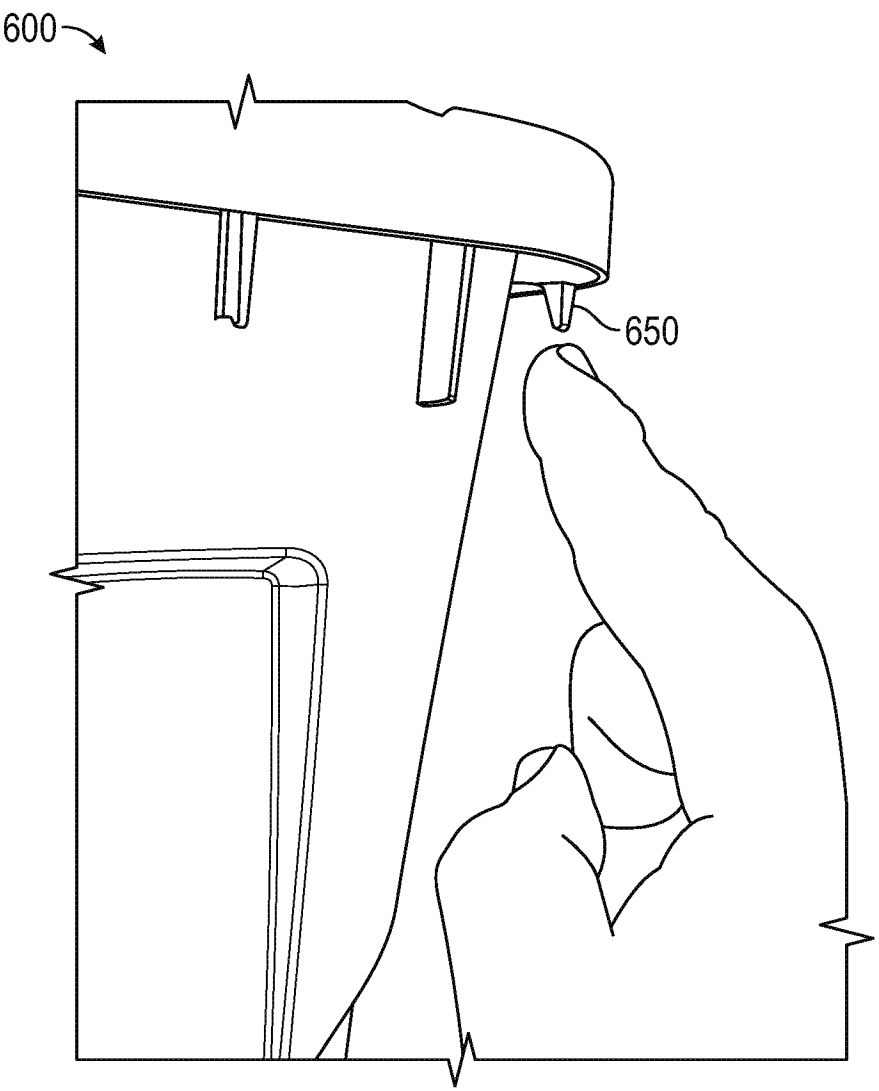

FIG. 6A shows exterior tab feature 650 on container 600 configured to couple to a plastic bag or liner. Tab feature 650 is configured to hold the bag or liner in place in the container. In some embodiments, a container may comprise one or more such features on an exterior and/or on an interior thereof to hold a plastic bag or liner in place. A lid may also comprise one or more of such features. In some embodiments, a plastic bag or liner may be from about 39 gallons in size to about 45 gallons in size, or larger.

FIG. 6B shows recessed handle 605 located towards a lower bottom section of a front container wall. Wheels 608 and an axle are also shown.

In some embodiments, a lid may be completely removed from a container body. In other embodiments, a lid may be coupled to a container body via one or more hinges or other features. In some embodiments, a lid may be adapted to snap on and off of the container.

In some embodiments, a lid door may be completely removable from the lid. In some embodiments, a lid door may be configured to snap on and off the lid. In some embodiments, a lid door may be coupled to a lid via one or more hinges. A lid door may comprise one or more closing features including latches, hooks, snaps, and the like.

In some embodiments, a lid door may be removably attached to a lid. A lid door may comprise flanges configured to couple to and slide in grooves of a lid in order to open and close. In some embodiments, a flange may be more flexible than a main body of a door, which may aid in coupling/decoupling a door to/from a lid. In some embodiments, a lid may be curved upward towards a back end, which may provide a stop point for a slidably opened door.

In some embodiments, a container may comprise no wheels. In other embodiments, a container may comprise 1, 2, 3, or 4 wheels.

A container body may comprise a unitary construct, comprising for instance a thermoplastic polymer, for instance a polyolefin, a polyamide, a polystyrene, a polyester, or combinations thereof or copolymers thereof. The container may be a molded part, for example injection molded. Likewise, a lid may comprise a thermoplastic polymer, which may be the same or different than a container body.

In some embodiments, a recessed handle may be located from about 1 inch, about 2 inches, about 3 inches, or about 4 inches, to about 5 inches, about 6 inches, about 7 inches, about 8 inches, about 9 inches, about 10 inches, or more, from a bottom edge of a container lower base. In some embodiments, an extending handle may be located from about 1 inch, about 2 inches, about 3 inches, or about 4 inches, to about 5 inches, about 6 inches, about 7 inches, about 8 inches, about 9 inches, about 10 inches, or more, from a top edge of a container top edge. An aligned extending handle/recessed handle pair may be positioned to provide for maximum ergonomic comfort during lowering of a container onto its side and lifting it from its side to an upright position. In some embodiments, an extending handle may be positioned in or may straddle a recessed section.

In some embodiments, a distance from an upper extending handle to a corresponding lower recessed handle, for instance extending and recessed side handles positioned in or straddling a wall recessed section, may be from any of about 22.0 inches, about 22.5 inches, about 23.0 inches, about 23.5 inches, about 24.0 inches, about 24.5 inches, about 25.0 inches, or about 25.5 inches, to any of about 26.0 inches, about 26.5 inches, about 27.0 inches, about 27.5 inches, about 28.0 inches, about 28.5 inches, about 29.0 inches, about 29.5 inches, about 30.0 inches, about 30.5 inches, or about 31.0 inches, or more. Corresponding extending and recessed handles means on a same side. A distance may be measured from a handle mid-point to mid-point.

In some embodiments, extending handles and/or recessed handles may comprise a surface having a plurality of raised features and/or a rubber-like surface configured to provide an improved grip.

In some embodiments, a container and/or a lid may comprise one or more features adapted to hold tools, for instance rakes, shovels, brooms, shears, and the like. Features may include molded-in ring-like structures configured to slide handles into.

In some embodiments, a lid and/or a lid door may be configured to be completely removed from the container or lid opening, but yet remain attached to the container or lid. That is, a lid or a lid door may comprise a tether, cord, or other feature which may allow it to be completely removed from the opening yet remain attached.

In some embodiments, the container/lid assembly is suitable where repeated insertion of refuse is desired but complete removal of the lid is not desired. A lid door allows for repeated insertion of refuse without removal of the entire lid. In some embodiments, a lid door may be left in an open position for a high volume of short term insertion of refuse, or may be left in a closed position for an irregular insertion of refuse. In some embodiments, a lid door may comprise a compression spring, spring-adapted hinge, or other feature, adapted to automatically close the door after an operator opens it to insert refuse.

In some embodiments, a container/lid assembly may be animal-proof, for instance impenetrable by raccoons, squirrels, and the like.

In some embodiments, extending handles may comprise one or more holes or perforations configured to allow for water or other fluid to run through. In other embodiments, an extending handle may be hollow or may be "semi-hollow", that is, being open on a side thereof. A semi-hollow extending handle may be considered to have a smooth, convex side and a hollow, concave side. In some embodiments, a convex side may face up when a container is in an upright standing position. In some embodiments, side extending handles may have a convex side may face up and a front extending handle may have a concave side facing up when a container is in an upright position. In other embodiments, this configuration may be reversed. In other embodiments, three extending handles may all have a convex side face up, or may all have a convex side face down with a container in an upright position.

In some embodiments, a lower base section of a container may comprise one or more openings or perforations configured to allow for water or other fluid to run through.

In some embodiments, a container lower base section may comprise one or more drains. A drain may be located towards a wall lower section and/or in a bottom of the container. A drain may be located where a wall and a container bottom meet. A drain may be adapted to be opened and closed via a plug, screw cap, and the like. A drain may allow for escape of water or other fluid and prevent entry of insects and the like.

In some embodiments, a lid opening and door may be positioned on a "flat" section of a lid, wherein the opening and door are substantially parallel with the ground when a container is in an upright position. A lid may also comprise an angled portion or section, which angled section may generally follow an angle and shape of a container top edge. Such a construction is shown for instance in lid side views of the figures.

Following are some embodiments of the invention.

In a first embodiment, disclosed is a container assembly for collecting and/or storing refuse, the assembly comprising a container body and a lid, wherein the container body comprises a wall section and a lower base section defining a container body interior, the container body having an open top end, the lid is configured to enclose the body open end, the lid comprises an opening configured for insertion of matter into the container body, the lid opening accounts for a portion of a total surface area of the lid and the opening, and the lid comprises a door configured to open and close the lid opening.

In a second embodiment, disclosed is a container assembly according to the first embodiment, wherein the container is a refuse container or a storage container.

In a third embodiment, disclosed is a container according to embodiments 1 or 2, wherein the lid opening accounts for from any of about 5%, about 7%, about 9%, about 10%, about 12%, about 14%, about 16%, about 19%, about 22%, about 25%, or about 27%, to any of about 30%, about 33%, about 36%, about 39%, about 43%, about 46%, about 49%, about 53%, about 57%, about 61%, about 63%, about 67%, about 70%, about 73%, about 76%, about 78%, about 81%, or more, of the total surface area of the lid and the opening.

In a fourth embodiment, disclosed is a container assembly according to any of the preceding embodiments, wherein the container body comprises one or more extending handles located towards a top section of the body.

In a fifth embodiment, disclosed is a container assembly according to any of the preceding embodiments, wherein the container body comprises one or more recessed handles located towards a bottom section of the body. In a sixth embodiment, disclosed is a container assembly according to any of the preceding embodiments, wherein the container body comprises one or more extending handles located towards a top section of the body and one or more recessed handles located towards a bottom section of the body, wherein the top handles and bottom handles are aligned.

In a seventh embodiment, disclosed is a container assembly according to any of the preceding embodiments, wherein the container body is configured to be removably coupled with a dust pan edge adapter.

In an eighth embodiment, disclosed is a container assembly according to any of the preceding embodiments, wherein the container body interior comprises a volume of from any of about 30 gallons, about 31 gallons, about 32 gallons, about 33 gallons, about 34 gallons, about 35 gallons, or about 36 gallons, to any of about 37 gallons, about 38 gallons, about 39 gallons, about 40 gallons, about 41 gallons, about 42 gallons, about 43 gallons, about 44 gallons, about 45 gallons, about 46 gallons, about 47 gallons, about 48 gallons, about 49 gallons, or more.

In a ninth embodiment, disclosed is a container assembly according to any of the preceding embodiments, wherein container body comprises a substantially trapezoidal shape. In a tenth embodiment container assembly according to any of the preceding embodiments, wherein the container body comprises a substantially straight top rear edge. In an eleventh embodiment, disclosed is a container assembly according to any of the preceding embodiments, wherein the wall section comprises a front wall, a rear wall, a left side wall, and a right side wall.

In a twelfth embodiment, disclosed is a container assembly according to any of the preceding embodiments, wherein the wall section comprises a front wall, a rear wall, a left side wall, and a right side wall, wherein the rear side wall comprises a substantially straight top edge and comprises no extending handle.

In a thirteenth embodiment, disclosed is a container assembly according to any of the preceding embodiments, wherein the wall section comprises a front wall, a rear wall, a left side wall, and a right side wall, and wherein the rear side wall is greater in length than the front wall and/or wherein the rear side wall is greater in width than the front wall.

In a fourteenth embodiment, disclosed is a container assembly according to any of the preceding embodiments, wherein the wall section comprises a front wall, a rear wall, a left side wall, and a right side wall, and wherein each of the left, right and front walls comprise an extending handle located towards a top section thereof and a recessed handle located towards a bottom section thereof.

In a fifteenth embodiment, disclosed is a container assembly according to any of the preceding embodiments, wherein the wall section comprises a front wall, a rear wall, a left side wall, and a right side wall, wherein the left and right walls comprise an extending handle located towards a top section thereof, and wherein the handles are positioned at an angle relative to the base.

In a sixteenth embodiment, disclosed is a container assembly according to any of the preceding embodiments, wherein the wall section comprises a front wall, a rear wall, a left side wall, and a right side wall, and wherein the left and right walls comprise a recessed section.

In a seventeenth embodiment, disclosed is a container assembly according to any of the preceding embodiments, wherein the wall section comprises a front wall, a rear wall, a left side wall, and a right side wall, wherein the left and right walls comprise a recessed section, and wherein the recessed sections comprise an extending handle located towards a top section thereof and comprise a recessed handle located towards a bottom section thereof. The term "recessed sections comprise an extending handle" may mean an entire handle is positioned in a recessed section, and may also mean a handle "straddles" a recessed section.

In an eighteenth embodiment, disclosed is a container assembly according to any of the preceding embodiments, wherein the wall section comprises a front wall, a rear wall, a left side wall, and a right side wall, wherein each of the left, right and front walls comprise an extending handle located towards a top section thereof and a recessed handle located towards a bottom section thereof, and wherein an extending handle is from about 22.0 inches to about 31 inches from a corresponding recessed handle.

In a nineteenth embodiment, disclosed is a container assembly according to any of the preceding embodiments, wherein the wall section comprises a front wall, a rear wall, a left side wall, and a right side wall, and wherein a top edge of the left and right walls comprise an upwardly curved section towards the rear wall.

In a twentieth embodiment, disclosed is a container assembly according to any of the preceding embodiments, wherein the wall section comprises a front wall, a rear wall, a left side wall, and a right side wall, and wherein the rear wall is corrugated.

In a twenty-first embodiment, disclosed is a container assembly according to any of the preceding embodiments, wherein the wall section comprises a front wall, a rear wall, a left side wall, and a right side wall, and wherein the rear wall is from about 17 inches, about 18 inches, about 19 inches, about 20 inches, about 21 inches, or about 22 inches, to any of about 23 inches, about 24 inches, about 25 inches, about 26 inches, about 27 inches, about 28 inches, about 29 inches, or more in width.

In a twenty-second embodiment, disclosed is a container assembly according to any of the preceding embodiments, wherein the wall section comprises a front wall, a rear wall, a left side wall, and a right side wall, and wherein the rear wall is from about 27 inches, about 28 inches, about 29 inches, about 30 inches, about 31 inches, or about 32 inches, to any of about 33 inches, about 34 inches, about 35 inches, about 36 inches, about 37 inches, about 38 inches, about 39 inches, or more in length.

In a twenty-third embodiment, disclosed is a container assembly according to any of the preceding embodiments, wherein the wall section comprises a front wall, a rear wall, a left side wall, and a right side wall, and wherein the front wall is from about 14 inches, about 15 inches, about 16 inches, about 17 inches, about 18 inches, or about 19 inches, to any of about 20 inches, about 21 inches, about 22 inches, about 23 inches, about 24 inches, about 25 inches, about 26 inches, or more in width.

In a twenty-fourth embodiment, disclosed is a container assembly according to any of the preceding embodiments, wherein the wall section comprises a front wall, a rear wall, a left side wall, and a right side wall, and wherein the front wall is from about 24 inches, about 25 inches, about 26 inches, about 27 inches, about 28 inches, or about 29 inches, to any of about 30 inches, about 31 inches, about 32 inches, about 33 inches, about 34 inches, about 35 inches, about 36 inches, or more in length.

In a twenty-fifth embodiment, disclosed is a container assembly according to any of the preceding embodiments, wherein the container body comprises one or more wheels located at the lower base section.

In a twenty-sixth embodiment, disclosed is a container assembly according to any of the preceding embodiments, wherein the container body comprises one or more features configured to removably couple to a plastic bag or liner.

In a twenty-seventh embodiment, disclosed is a container assembly according to any of the preceding embodiments, wherein the lid is configured to be removably coupled to the container body.

In a twenty-eighth embodiment, disclosed is a container assembly according to any of the preceding embodiments, wherein the lid door is configured to be removably coupled to the lid.

In a twenty-ninth embodiment, disclosed is a container assembly according to any of embodiments 1 to 27, wherein the lid door is coupled to the lid.

In a thirtieth embodiment, disclosed is a container assembly according to any of the preceding embodiments, wherein the lid door is configured to slidably open and close.

In a thirty-first embodiment, disclosed is a container assembly according to any of the preceding embodiments, wherein the lid door is configured to rotationally open and close.

In a thirty-second embodiment, disclosed is a container assembly according to any of the preceding embodiments, wherein the lid door comprises a handle.

In a thirty-third embodiment, disclosed is a container according to any of the preceding embodiments. In a thirty-fourth embodiment, disclosed is a lid according to any of embodiments 1 to 32.

Features described in connection with one embodiment of the disclosure may be used in conjunction with other embodiments, even if not explicitly stated above.

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "towards" in reference to a of point of attachment or a location, may mean at exactly that location or point or, alternatively, may mean closer to that point or location than to another distinct point or location, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

The invention claimed is:

1. A container assembly for collecting and/or storing refuse, the assembly comprising a container body and a lid, wherein the container body comprises a wall section and a lower base section defining a container body interior, the container body having an open top end, the wall section comprises a front wall, a rear wall, a left side wall, and a right side wall, a top edge of the left side wall and the right side wall each comprising an upwardly curved section adjacent a rear wall top edge, the lid is configured to enclose the body open end, the lid comprises an opening configured for insertion of matter into the container body, the lid opening accounts for from about 10% to about 55% of a total surface area of the lid and the opening, the lid comprises a door configured to open and close the lid opening, the lid door is configured to slide over the lid relative to the lid opening, the lid opening and the lid door are positioned on a lid flat portion, wherein the lid opening, the lid door, and the lid flat portion are substantially parallel with each other, the lid comprises grooves adjacent to the lid opening, and the lid door comprises flanges configured to couple to and slide in the grooves.

2. The container assembly according to claim 1, wherein the lid opening accounts for from about 15% to about 55%, of the total surface area of the lid and the opening.

3. The container assembly according to claim 1, wherein the container body comprises one or more extending handles located towards a top section of the body, and one or more recessed handles located towards a bottom section of the body.

4. The container assembly according to claim 1, wherein the container body interior comprises a volume of from about 30 gallons to about 49 gallons.

5. The container assembly according to claim 1, wherein container body comprises a substantially trapezoidal shape.

6. The container assembly according to claim 1, wherein the wall section comprises a front wall, a rear wall, a left side wall, and a right side wall, wherein each of the left, right and front walls comprise a recessed section, and wherein the recessed sections comprise an extending handle located towards a top section thereof and a recessed handle located towards a bottom section thereof.

7. The container assembly according to claim 1, wherein the rear wall is longer and wider than the front wall.

8. The container assembly according to claim 1, wherein the wall section comprises a front wall, a rear wall, a left side wall, and a right side wall, and wherein the rear wall is from about 27 inches to about 39 inches in length, and about 17 inches to about 29 inches in width.

9. The container assembly according to claim 1, wherein the lid comprises an upwardly curved section at a back end thereof, providing a stop point for the lid door.

10. The container assembly according to claim 9, wherein the left side wall and right side wall upwardly curved sections are configured to receive the lid upwardly curved section.

11. The container assembly according to claim 1, wherein the wall section comprises a front wall, a rear wall, a left side wall, and a right side wall, and wherein the front wall is from about 24 inches to about 36 inches in length, and about 14 inches to about 26 inches in width.

12. The container assembly according to claim 1, wherein the container body comprises one or more wheels located at the lower base section.

13. The container assembly according to claim 1, wherein the container body comprises one or more features configured to removably couple to a plastic bag or liner.

14. The container assembly according to claim 1, wherein the lid is configured to be removably coupled to the container body.

15. The container assembly according to claim 1, wherein the lid door is configured to be removably coupled to the lid.

16. The container assembly according to claim 15, wherein the lid door flanges are more flexible than a main body of the door to aid coupling and de-coupling the door to the lid.

17. The container assembly according to claim 1, wherein the lid door comprises an upwardly extending handle.

18. The lid according to claim 1.

19. The container assembly according to claim 1, wherein the container rear wall top edge is substantially straight and flat, configured to provide a dust pan edge.

20. The container assembly according to claim 19, wherein the container top rear edge is higher than a container top front edge with the container in an upright position.

* * * * *